US007013805B2

(12) United States Patent
Hoffmann et al.

(10) Patent No.: US 7,013,805 B2
(45) Date of Patent: Mar. 21, 2006

(54) RUBBER CYLINDER SLEEVE FOR OFFSET PRESSES

(75) Inventors: Eduard Hoffmann, Bobingen (DE); Christian Sameit, Augsburg (DE); Georg Schmid, Neusäss (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/732,973

(22) Filed: Dec. 10, 2003

(65) Prior Publication Data

US 2004/0118307 A1 Jun. 24, 2004

(30) Foreign Application Priority Data

Dec. 10, 2002 (DE) ..... 102 57 745

(51) Int. Cl.
*B41F 13/10* (2006.01)

(52) U.S. Cl. ..... 101/376; 101/375; 428/909

(58) Field of Classification Search ..... 101/375–376, 101/216–217, 177, 181; 428/909
See application file for complete search history.

(56) References Cited

U.S. PATENT DOCUMENTS 5,304,267 A 4/1994 Vrotacoe et al.
5,323,702 A * 6/1994 Vrotacoe et al. ..... 101/217
5,429,048 A 7/1995 Gaffney et al.
5,440,981 A 8/1995 Vrotacoe et al.
6,105,498 A * 8/2000 Vrotacoe et al. ..... 101/376
6,283,027 B1 9/2001 Vrotacoe et al.

FOREIGN PATENT DOCUMENTS

| | | |
|---|---|---|
| DE | 44 36 9973 A1 | 6/1995 |
| EP | 0 421 145 B1 | 12/1993 |
| EP | 0 715 966 A1 | 6/1996 |
| JP | 2002301880 | 10/2002 |

OTHER PUBLICATIONS

U.S. Appl. No. 10/606,544, Hoffmann et al.

* cited by examiner

*Primary Examiner*—Daniel J. Colilla
*Assistant Examiner*—Marissa Ferguson
(74) *Attorney, Agent, or Firm*—Cohen, Pontani, Lieberman & Pavane

(57) ABSTRACT

A rubber cylinder sleeve has a rubber covering with a layer construction which includes, at a distance from the outer surface, compressible layer elements and layer elements which influence the stiffness (S), such as filaments/yarns or fabric structures. The layer elements which influence the stiffness (S), are incorporated uniformly in the circumferential direction but are prestrained to various degrees in a defined manner in the direction of the sleeve axis, so that a stiffness profile is produced across the sleeve width, which profile is symmetrical with respect to the center of the sleeve width.

7 Claims, 1 Drawing Sheet

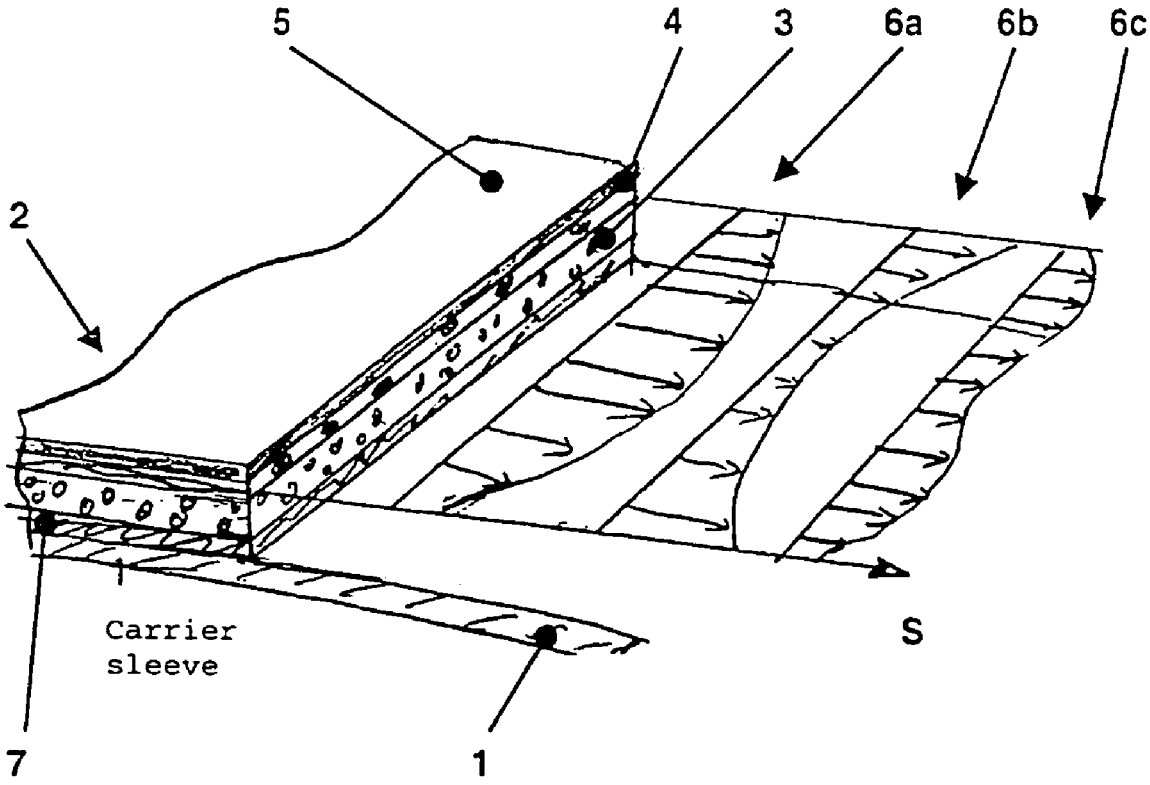
5
4
3
6a
6b
6c
2
Carrier
sleeve
S
7
1

RUBBER CYLINDER SLEEVE FOR OFFSET PRESSES

BACKGROUND OF THE INVENTION

1. Field of the Invention

The invention relates to a rubber cylinder sleeve of the type having a carrier sleeve which can be expanded using air and a rubber covering on the carrier sleeve.

2. Description of the Related Art

Rubber cylinder sleeves are known in which a carrier sleeve is provided with a rubber covering, the rubber covering comprising three or more layers. EP 0 421 145 B1 is to be cited here by way of example.

In rotary offset presses, as is known, the printing image is transferred from the plate or forme cylinder onto the rubber cylinder and from the latter onto the paper running over the impression cylinder. It is only possible to transfer the ink, both from the printing forme onto the rubber sleeve and from the rubber sleeve onto the paper, if a certain minimum pressure is present, what is known as the line pressure between the blanket cylinder and plate or forme cylinder or impression cylinder.

Here, a problem arises for quality assurance from the demand for ever higher productivity, and as a result of the efforts to produce impression cylinders which are as light and cost-effective as possible. Especially what is referred to as channel-less printing, in particular therefore the sleeve technique, which is distinguished by a printing forme applied without a channel onto a sleeve and/or a rubber blanket applied without a channel, allows the rigidity to be reduced because of the lessened oscillation excitation as a result of the missing cylinder channels. As a result, the length-to-thickness ratio of the printing cylinders, or their relative rigidity with regard to deflection, becomes ever more unfavorable. The consequence of this is that, during printing operation, the shape and position of the printing cylinders with respect to one another change in an undesired manner, i.e. the printing cylinders are deflected.

The positional change as a consequence of a deflection changes the printing pressure, i.e. the setting pressure between the printing cylinders interacting in the printing unit, this setting pressure becoming non-uniform as seen across the cylinder width. This printing pressure is usually determined in numerical values by measuring what is referred to as the imprint width, i.e. the width of the zone which defines the contact area of the cylinders when the cylinders are thrown onto one another, i.e. moved to the pressure position. This measurement is particularly simple in offset printing, since here one cylinder of a pair of cylinders always has a compressible (soft) surface.

As a result of the mechanical misalignment remaining with this, it is known that folds can form in the conveyed paper web in the press nip of the rubber cylinder if the paper web is moving here with an irregular speed profile across the width because of the above-described positional change, the center of the paper web moving more quickly than the outside of the web, which leads to the formation of folds. The web transport behavior in web-fed offset presses is critically influenced, however, by the conveying characteristics of the rubber blankets. In sleeve presses, in particular, it is the case that folds may form across the web width, which impair the page register. To remove this problem, for example in DE 44 36 973 A1, rubber sleeves have already been configured with a concave or convex surface geometry across the web width, i.e. a thickness profile varied by the circumferential surface assuming a convex or concave shape on the blanket cylinder in the axial direction of the cylinder.

In this document, it is also proposed to vary the compressibility or the rigidity in the axial direction, radial variables being concerned in each case here, i.e. the radial compressibility and the radial rigidity are taken as a basis (as has been the case in the prior art for a long time), but these variables should be different in the axial direction, according to this document, as has been mentioned respectively in the radial direction, i.e. as seen transversely through the plane of the rubber blanket.

Although the deflection between a blanket cylinder and a plate or forme cylinder can be compensated for by a convex profile of the blanket-cylinder surface, the contact is impaired, on the other hand, between the two blanket cylinders in a printing unit for recto and verso printing. This has a negative influence on both the web transport and the ink transfer to the paper web. Although the contact between the two blanket cylinders in the press nip is improved by a concave blanket-cylinder surface, the ink transfer from the plate or forme cylinder to the blanket cylinder is then impaired. The results are similar if the compressibility or rigidity is changed in the axial direction (seen radially).

Moreover, the above-described measures to influence the conveying characteristics have the disadvantage that the radial compressibility or radial rigidity is modified over the sleeve length, which in turn impairs the print quality, in particular the tonal value gain.

SUMMARY OF THE INVENTION

It is an object of the present invention to develop a rubber cylinder sleeve of the type described in the introduction so that quality assurance in rotary printing is possible, in which it is possible to influence the conveying characteristics of the rubber sleeve without impairing the radial compressibility or the radial rigidity over the sleeve length.

According to the invention, the rubber covering has a layer with compressible layer elements and a layer with elastic layer elements. The elastic layer elements are uniform in the circumferential direction and prestrained to varying degrees as a function of axial position so that the sleeve has a tangential stiffness (rigidity) profile which is symmetric with respect to the axial center of the sleeve.

By virtue of the fact that, according to the invention, the stiffness of a rubber sleeve is modified across the web width and is not impaired in the circumferential direction, it is firstly possible to influence the conveying characteristics across the paper-web width without, however, impairing the compressibility of the rubber sleeve.

This measure can be applied to rubber sleeves both with and without gaps and also to conventional rubber blankets.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

The single figure shows a rubber cylinder sleeve in cross section with a layer construction and the representation of profiles of the stiffness S ("circumferential rigidity" or "circumferential stiffness").

DETAILED DESCRIPTION OF THE PREFERRED EMBODIMENT

The rubber cylinder sleeve comprises an inner carrier sleeve 1 which can be expanded using air and to which a rubber covering 2 is fixed, which comprises a plurality of layers 3, 4, 5. In the exemplary embodiment, the carrier sleeve 1 is composed of a metal, for example of steel, and is produced from a plate, the ends of which are welded together, so that a butt joint is produced. It is, however, also possible to configure the carrier sleeve 1 to be endless, that is to say without a butt joint, produced, for example, galvanically from nickel. It is also possible for the carrier sleeve 1 to be composed of a plastic, for example of a fiber-reinforced epoxy resin, for example CRP. In all cases, it is possible to expand the carrier sleeve 1 elastically by means of compressed air and to push it in this way axially onto a printing-unit cylinder.

The layer construction 2 is usually vulcanized or adhesively bonded onto the carrier sleeve 1, forming an adhesive layer 7, butt joints being configured as adhesive joints.

The construction of the layers comprises compressible layer elements 3 in the form of air inclusions, and elastic layer elements 4 which influence the stiffness in the form of filaments/fabric structures or yarns. The filaments are aligned approximately in the circumferential direction of the rubber cylinder sleeve and advantageously have a length of approximately 10 to 30 mm. It is also possible to provide compressible filaments instead of the air inclusions. The layer construction comprises, furthermore, a rubber material 5, as is customarily used for rubber blankets. As has already been described, for example, in U.S. Pat. No. 6,799,512, incorporated herein by reference, the filaments are not necessarily distributed uniformly in the layer 4. More air inclusions are arranged in the radial direction towards the carrier sleeve 1, while the filaments are arranged more closely in the radial direction towards the outer surface. Correspondingly, the stiffness S in the region of the thickness d of the layer increases towards the outside, while the relative compressibility K increases towards the carrier sleeve 1.

It is, however, equally conceivable to arrange the filaments more closely in the layer 4 towards the outer surface, so that the stiffness S increases in this direction, and to distribute air inclusions uniformly, so that the radial compressibility is identical across the entire width of the layer 3.

Further variations of arranging the compressible elements and the filaments in the radial direction are possible. This is merely a preferred exemplary embodiment; the layer construction 2 can have any desired arrangements of the layers 3, 4, 5.

Although, in a previously described rubber sleeve, the layer elements in the form of filaments/yarns or fabric structures which influence the circumferential stiffness S are in every case incorporated uniformly in the layer construction 2 in the circumferential direction (that is to say in the direction of the arrow S), according to the present invention they are incorporated in the direction of the sleeve axis X in a manner which is prestrained to various degrees, so that a non-uniform circumferential stiffness profile 6*a*, 6*b*, 6*c* is produced across the sleeve width.

The prestraining of the layer elements 4 which influence the stiffness S of the sleeve is preferably carried out in a defined manner using suitable tools and producing a selected stiffness profile 6*a*, 6*b*, 6*c*, and is preserved by adhesive bonding on the carrier sleeve 1 by means of the adhesive layer 7. It is, however, also possible to perform the prestraining when the rubber sleeve is pulled onto the cylinder, with the disadvantage that it is no longer possible to produce the stiffness profile in such a defined or controlled manner.

The term "profile" here means that different circumferential stiffness values S vary in the layer construction in the axial direction of the sleeve, under the condition that the profile is designed to be symmetrical with respect to the center of the sleeve width.

In the figure, 6*a*, 6*b* and 6*c* denote three different profile examples which, although they cannot be used simultaneously, can nevertheless be effectively used individually.

Thus, 6*a* shows a "convex" stiffness profile of the layer construction 2, so that it is possible to compensate for the speed differences of the paper web along the press nip which result in folds forming in the paper web.

In contrast, 6*b* shows a "concave" stiffness profile, while 6*c* shows a "doubly convex" stiffness profile.

It is possible to produce all the profiles shown here (and also further profiles) in a desired manner by prestraining the filaments/yarns or fabric structures and to preserve them in the rubber sleeve, which represents the core of the invention.

If the geometry of the profile 6*a*, 6*b*, 6*c* in the layer construction 2 of the rubber sleeve is selected carefully, a rubber blanket is obtained which has a uniform surface speed, during use, along the press nip through which the paper web runs, so that the formation of folds as a result of the varying profiles 6*a*, 6*b*, 6*c* is prevented, the different radial stiffness and compressibility values according to the prior art not being necessary.

Empirical tests have shown that the best results can be achieved if the stiffness in the circumferential direction of the sleeve, compared with a stiffness which extends uniformly over the sleeve axis, has a profile in the axial direction in which the speed profile of the conveyed paper web across the web width is changed in such a way that the conveying behavior of the rubber cylinder sleeve is influenced across the web width in a range of $-0.5\% < 0 < +0.5\%$.

The invention is not limited by the embodiments described above which are presented as examples only but can be modified in various ways within the scope of protection defined by the appended patent claims.

We claim:

1. A rubber cylinder sleeve for an offset printing press, the rubber cylinder sleeve having a circumferential direction, an axial direction, and a width in the axial direction, the width having an axial center, the sleeve comprising:

an inner carrier sleeve which can be expanded outwardly using air; and a rubber covering on the inner carrier sleeve, the rubber covering comprising a first layer bonded to said carrier sleeve and having compressible layer elements and a second layer having elastic layer elements, the elastic layer elements being uniform in the circumferential direction and prestrained to varying degrees as a function of axial position so that the sleeve has a tangential stiffness profile which varies in the axial direction and is symmetric with respect to the axial center of the sleeve.

2. A rubber cylinder sleeve as in claim 1 wherein the tangential stiffness profile affects the speed profile of a conveyed paper web in a range of −0.5% to +0.5% across the width of the web.

3. A rubber cylinder sleeve as in claim 1 wherein said rubber covering further comprises a third layer over said first and second layers, said third layer consisting of rubber.

4. A rubber cylinder sleeve as in claim 1 wherein said tangential stiffness profile is convex.

5. A rubber cylinder sleeve as in claim 1 wherein said tangential stiffness profile is concave.

6. A rubber cylinder sleeve as in claim 1 wherein said tangential stiffness profile is double convex.

7. A rubber cylinder sleeve as in claim 1 wherein said elastic elements are filaments.

* * * * *